United States Patent [19]

Okamoto

[11] Patent Number: 4,928,143

[45] Date of Patent: May 22, 1990

[54] IMAGE FORMING APPARATUS WITH IMAGE ERASING LAMP

[75] Inventor: Yuji Okamoto, Nara, Japan

[73] Assignee: Sharp Kabushiki Kaisha, Osaka, Japan

[21] Appl. No.: 106,416

[22] Filed: Oct. 6, 1987

[30] Foreign Application Priority Data

Oct. 9, 1986 [JP] Japan ..... 61-240755

[51] Int. Cl.[5] ..... G03G 15/00

[52] U.S. Cl. ..... 355/218; 355/40

[58] Field of Search ..... 355/3 R, 4, 7, 40, 14 E, 355/202, 218, 244, 328

[56] References Cited

U.S. PATENT DOCUMENTS 4,582,417 4/1986 Yagasaki et al. ..... 355/7
4,707,110 11/1987 Harada et al. ..... 355/7
4,740,818 4/1988 Tsilibes et al. ..... 355/7 X

FOREIGN PATENT DOCUMENTS 61-205960 9/1986 Japan ..... 355/4

*Primary Examiner*—Arthur T. Grimley
*Assistant Examiner*—J. Pendegrass
*Attorney, Agent, or Firm*—Flehr, Hohbach, Test, Albritton & Herbert

[57] ABSTRACT

An image forming apparatus such as a copier includes not only an image erasing lamp having a plurality of point light sources which can be individually switched on and off and input keys by which a region can be specified but also a control unit which is so programmed that the point light sources are switched on and off during a copying process as the copier's photosensitive drum rotates and charges can be cancelled within a frame-shaped region on the photosensitive drum around a boundary defined by the input keys.

2 Claims, 6 Drawing Sheets

IMAGE FORMING APPARATUS WITH IMAGE ERASING LAMP

BACKGROUND OF THE INVENTION

This invention relates to an image forming apparatus provided with an image erasing lamp with which a portion of the image can be erased by removing charges from a part of its photosensitive drum such that toner is not attached thereonto.

With an image forming apparatus such as an electrophotographic copier, the surface of a photosensitive drum comprising a photoconductive layer is electrostatically charged first and a latent image is formed thereon by exposing this surface to a beam of light reflected from an original document to cancel the charges from exposed areas. Thereafter, toner is attached to the areas which are still charged, or were not exposed to light, to develop the electrostatic latent image into a visible image and a printed image is finally obtained by transferring this toner image onto a sheet of copy paper. In other words, toner does not become attached to areas on the photosensitive drum which have been exposed to light to have the electrostatic charges cancelled thereon. Thus, if an image erasing lamp (also referred to as blanking lamp) is incorporated in an image forming apparatus between a charger for electrostatically charging its photosensitive drum and a developing device for applying toner onto the surface of the drum, and if a specified area of the drum is exposed to light from the image erasing lamp in addition to the usual exposure of the drum surface to the reflected light from a document to be copied, the charges in such a specified area become completely cancelled from the light from the erasing lamp and toner does not attach thereonto. This principle has already been applied for trimming and masking modes of operation. Trimming is effected by exposing only the area outside a specified closed boundary to light such that image is formed only inside this boundary. Masking is effected by exposing only the area inside a specified closed boundary such that image is formed only outside this boundary.

With electrophotographic copiers of a conventional type, however, position can be specified only for a single closed boundary and the entire area inside or outside this boundary is completely cancelled. Thus, a frame-shaped region, which may be described as being outside one closed boundary and also inside another closed boundary, cannot be specified easily for trimming or masking by a conventional copier. One of the methods of specifying such a frame-shaped region to cancel the charges therein would be to divide the region into four rectangular subregions a, b, c, and d as shown in FIG. 6 and to specify each subregions successively to erase the image therein.

SUMMARY OF THE INVENTION

It is therefore an object of the present invention to provide an image forming apparatus provided with an image erasing lamp with which the user has only to specify one closed boundary to erase charges in a frame-shaped region therearound.

The above and other objects of the present invention are achieved by providing an image forming apparatus comprising not only an image erasing lamp disposed in the direction of the axis of its photosensitive drum between a charger for uniformly charging the surface of this drum and a developing device and including a plurality of point light sources which can be independently switched on and off and region setting means for setting a region on an original document sheet, but also frame-shaped region determining means and lamp control means such that a frame-shaped region with a specified width is determined around the region set by the region setting means and the image erasing lamp is controlled to erase charges from the region on the photosensitive drum corresponding to the frame-shaped region determined by the frame-shaped region determining means.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 4:
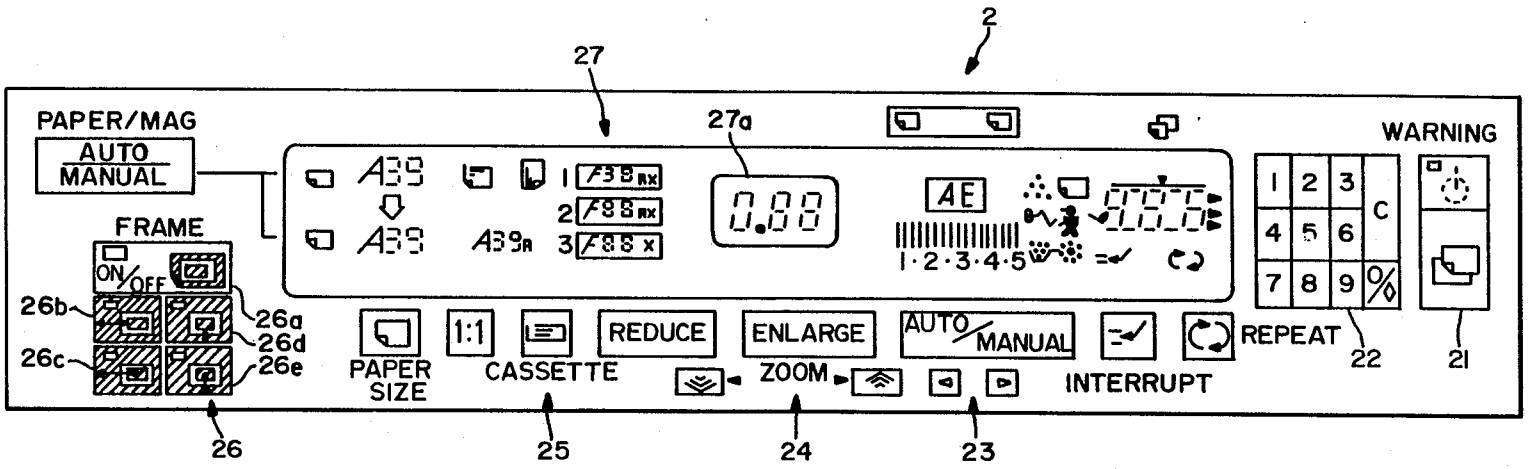
FIG. 4 is a plan view of the control panel of the copier.
Figure 5:
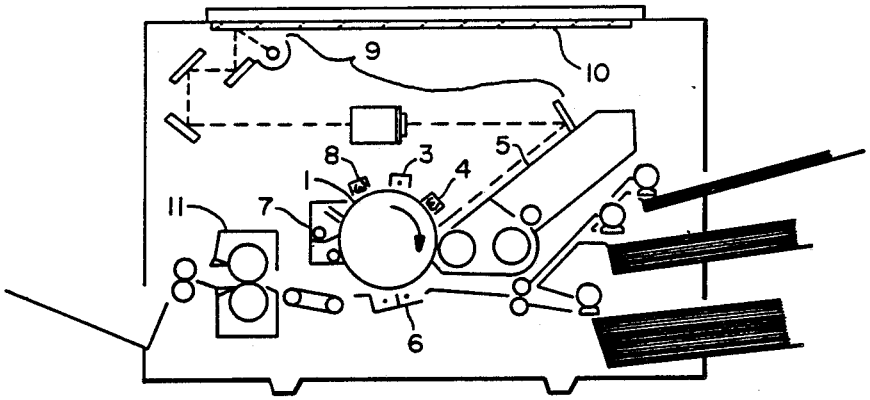
FIG. 5 is a schematic sectional view of the copier to show its overall structure.
Figure 6:
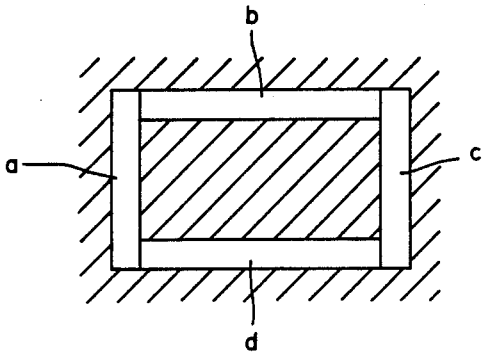
(PRIOR ART) FIG.—6
FIG. 6 is a drawing for showing a conventional method of defining a frame-shaped region for cancelling the charges therein.

With reference to FIG. 5, a copier embodying the present invention contains nearly at its center a photosensitive drum 1 which is rotatable in the clockwise direction as shown by an arrow. A charger 3, an image erasing lamp 4, a developing device 5, and an image transferrer-paper remover 6, a cleaning device 7, and a charge removing lamp 8 are disposed around the photosensitive drum 1 in this order. A control panel 2 shown in FIG. 4 is on the upper surface of the copier through which a mode of operation can be specified by entering various data.

A photoconductive layer is formed on the surface of the photosensitive drum 1, and the charger 3 is adapted to uniformly charge it. The charged region of the photosensitive drum 1 comes to face the erasing lamp 4 as the drum 1 rotates in the clockwise direction and a specified region of the surface of the drum 1 becomes exposed by light as will be explained below such that charges in such a specified region become cancelled. Numeral 9 indicates an optical system by means of which reflected light from an original document paper on a document table 10 is made incident on the photosensitive drum 1 to form an electrostatic latent image thereon. The developing device 5 thereupon applies toner on this latent image and the toner thus attached on the surface of the drum 1 is transferred to a copy sheet by the image transferrer-paper remover 6. The transferred toner is thereafter fixed on the copy sheet by a fixing device 11, thereby forming a visible image. In the meantime, the remaining toner on the photosensitive drum 1 is removed by the cleaner 7 and the residual charges on the drum 1 are cancelled by the charge removing lamp 8.

With reference next to FIG. 4, the control panel 2 disposed on the upper surface of the copier includes not only a print key 21, numeric keys 22, an exposure selection key 23, a magnification selection key 24 and a paper cassette selection key 25 but also several frame defining input keys 26. The print key 21 is for starting a copying process. Numeric keys 22 are used for inputting the number of copies to be made, data related to the frame-shaped region, etc. and the value inputted thereby is displayed on a number display panel 27*a*. Input data selected by the exposure selection key 23, the magnification selection key 24 and the paper cassette selection key 25 are also displayed at specified positions in a display section 27. The frame defining input keys 26 include an ON-OFF key 26*a*, an X1 input key 26*b*, and X2 input key 26*c*, a Y1 input key 26*d*, and a Y2 input key 26*e*. Functions of these frame defining input keys 26 are explained in detail below.

Figure 3:
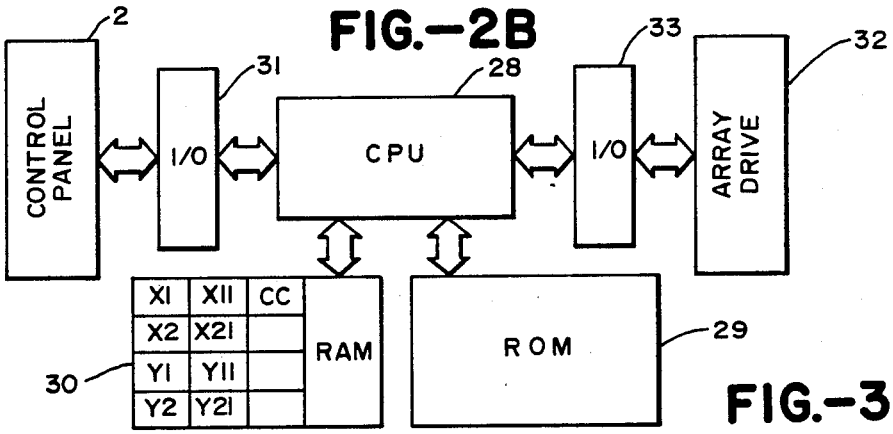
FIG. 3 is a block diagram of a control unit for this copier.

With reference next to FIG. 3, the overall operation of the copier is controlled by a central processing unit CPU 28 and its processing program is preliminarily stored in a read-only memory ROM 29. RAM 30 indicates a random-access memory which is used as a buffer memory, a flag and other computational work areas. Input signals from and display signals to the control panel 2 are transmitted through an I-O interface 31, and commands to a drive array 32 for controlling the image erasing lamp 4, etc. are transmitted through another I-O interface 33.

Figure 1A:
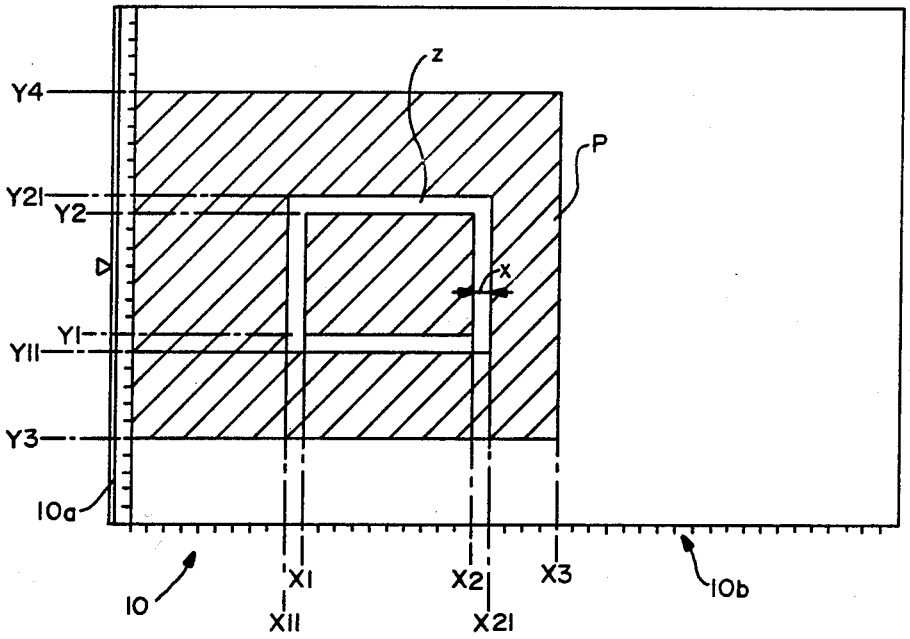
FIG. 1A is a schematic plan view of a document table of an image forming apparatus such as a copier embodying the present invention.
Figure 1B:
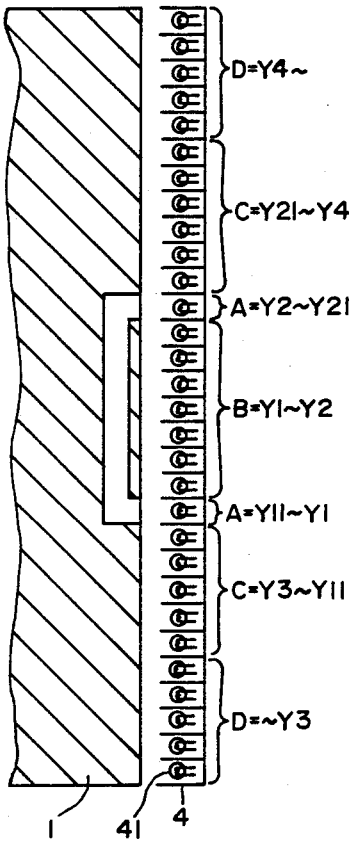
FIG. 1B is a drawing for schematically showing the structure of an image erasing lamp.

The image erasing lamp 4 is disposed in the direction of the axis of the cylindrical drum 1 as shown in FIG. 1B and is comprised of a plurality of light emitting diodes 41 serving as point light sources aligned parallel to the axis of the photosensitive drum 1. The range on the surface of the drum 1 in its axial direction which can be exposed by each of these light emitting diodes 41 is limited and well-defined. These light emitting diodes 41 can be individually switched on and off by the drive array disclosed schematically above by way of FIG. 3.

The document table 10 is made of a highly transparent material such as glass and scales 10*a* and 10*b* are provided along the vertical (Y) and horizontal (X) directions (as looked vertically downward), respectively. The Y-axis of the document table 10 is parallel to the axis of the photosensitive drum 1 shown in FIG. 1B and the X-axis corresponds to the time of rotation of the drum 1.

Figure 2A:
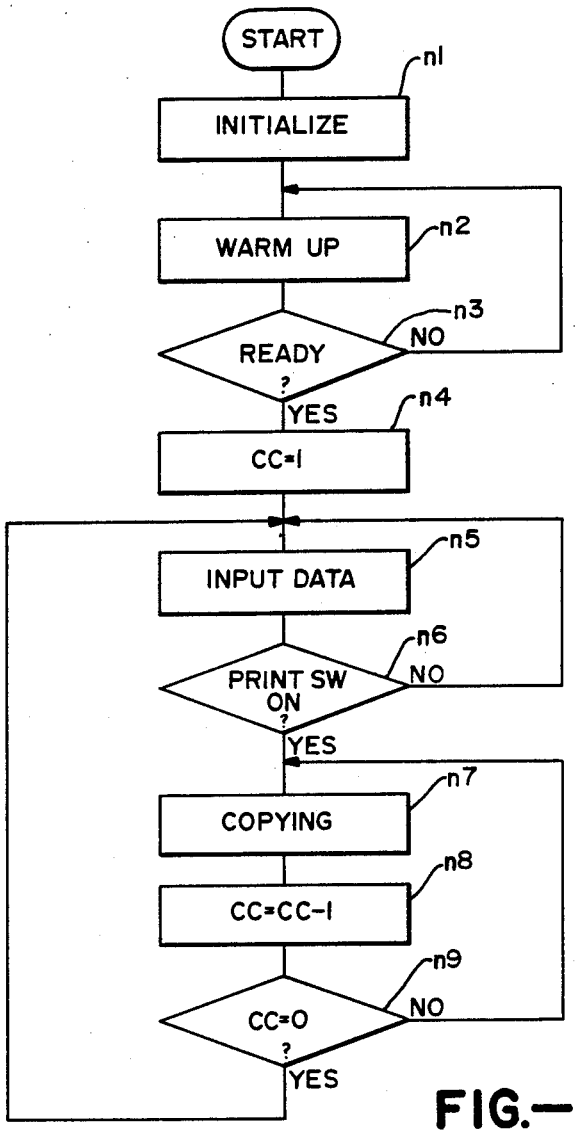
FIG. 2A is a flow chart for the operation of a copier embodying the present invention.

As an example, let us consider the operation of a copier thus structured whereby image to be cancelled from a specified frame-shaped region z of an original document sheet P placed on the document table 10 as shown in FIG. 1A by causing the light from the image erasing lamp 4 to be made incident on the region on the surface of the photosensitive drum 1 corresponding to this specified region z. With reference to the flow chart of FIG. 2A, the copier is initialized (n1) when the copier power switch (not shown) is switched on and the fixing device 11, etc. are warmed up (n2). When the warming-up process is completed (n3), the default value of 1 is set in the copy counter CC (n4) and the copier is now ready to accept various input data (n5). Step n5 in the flow chart of FIG. 2A is further described in detail by a separate flow chart in FIG. 2B. If the numeric keys 22 shown in FIG. 4 are operated (n50), for example, the value formed thereby is entered as the number of copies to be produced (n51) and displayed in the number display panel 27*a*. If the exposure selection key 23, the magnification selection key 24 or the cassette selection key 25 is operated, a corresponding input is similarly effected (shown by dotted lines in FIG. 2B). At the same time, the size of the document paper to be copied is also inputted automatically by means of a sensor (not shown). As shown in FIG. 1A, the size of the original document paper P under consideration as an example is characterized by the X coordinates in the range of 0–X1 and Y-coordinates in Y3–Y4. When the frame defining ON/OFF key 26*a* is switched on (n52), all the other frame defining input keys 26*b*–26*e* as well as the ON/-OFF key 26*a* itself begin to blink, showing that numeric values may now be entered (n53). At this moment the user uses the numeric keys 22 to input the coordinates of the inner rectangle of the frame-shaped region on the document paper P. For example, the coordinate X1 is determined from the horizontal scale 10*b* and its numerical value is formed by pressing the numeric keys 22. The user can ascertain that a correct value representing the coordinate X1 has been formed by checking the number appearing in the number display panel 27*a*. If a correct number is found to have been formed, the user may press the X1 input key 26*b*, thereby completing the input of the X1 coordinate (n54). This causes the X1 input key 26*b* to light up (n55). Coordinates X2, Y1 and Y2 are similarly inputted and the frame-shaped region is determined by calculations on the basis of these inputted values (n56). The width x of the frame-shaped region is preliminarily stored and the coordinates of the outer rectangle of the frame-shaped region are obtained by moving the sides of the inner rectangle in outward directions by x. The values thus obtained, or $X11=X1-x$, $X21=X2+x$, $Y11=Y1-x$ and $Y21=Y2+x$ are also stored (n56). If it is desired to correct an already inputted value, the user has only to press the corresponding input key 26*b*, 26*c*, 26*d* or 26*e*. The input key thus pressed begins to blink again and the user can reenter a new value as the corrected coordinate (n57). When all coordinate values X1, X2, Y1 and Y2 are entered, the frame-defining ON/OFF key 26*a* lights up.

Figure 1C:
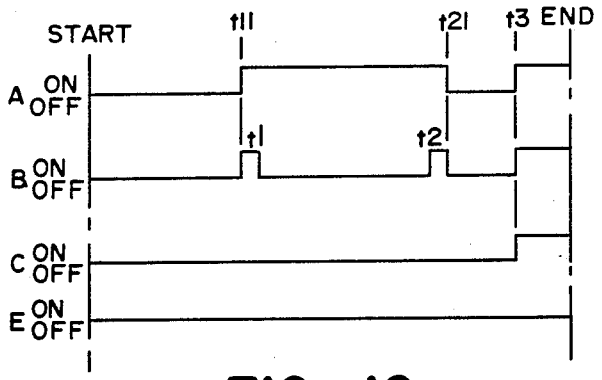
FIG. 1C is an example timing chart for the operation of the image erasing lamp of FIG. 1B.
Figure 2C:
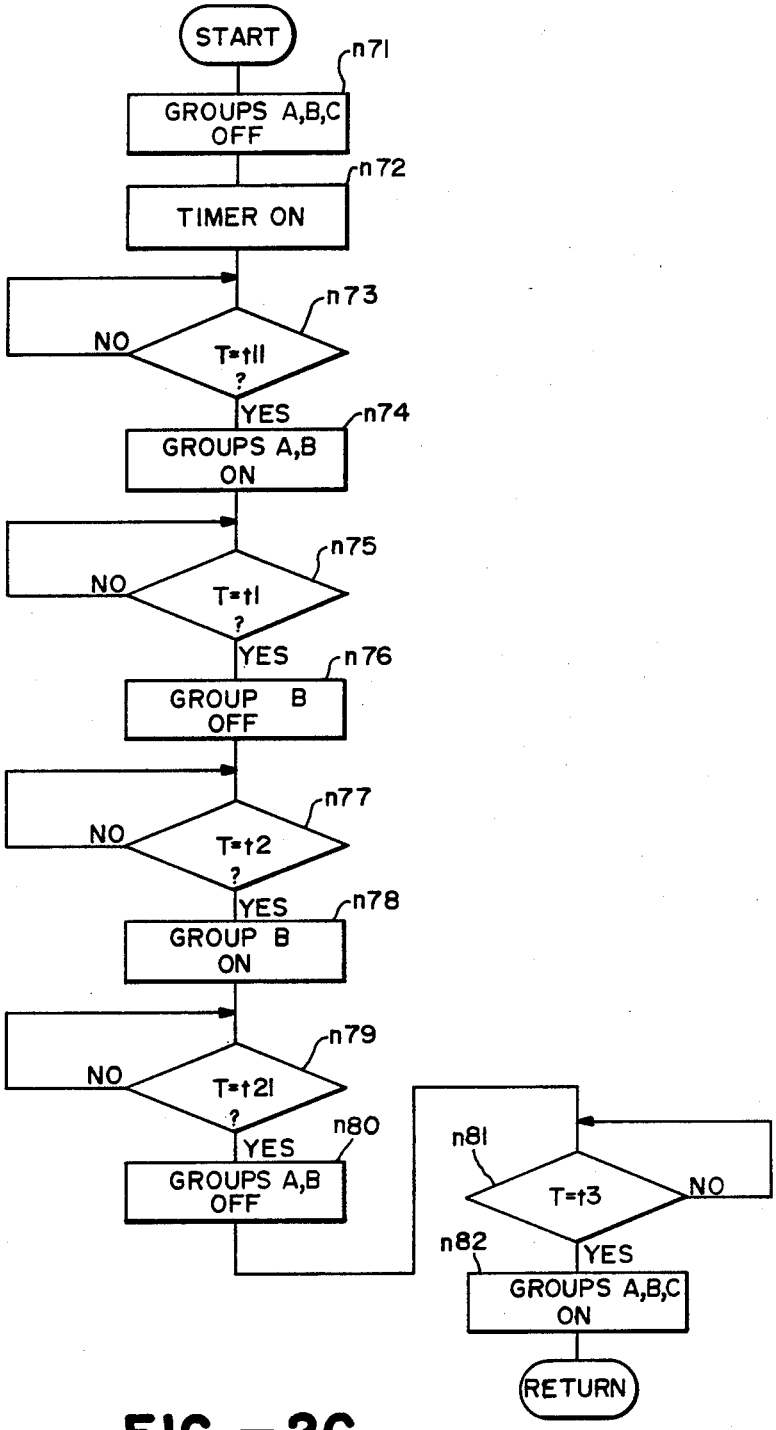
FIG. 2C is a flow chart for the control of the image erasing lamp during a copying process.
Figure 2B:
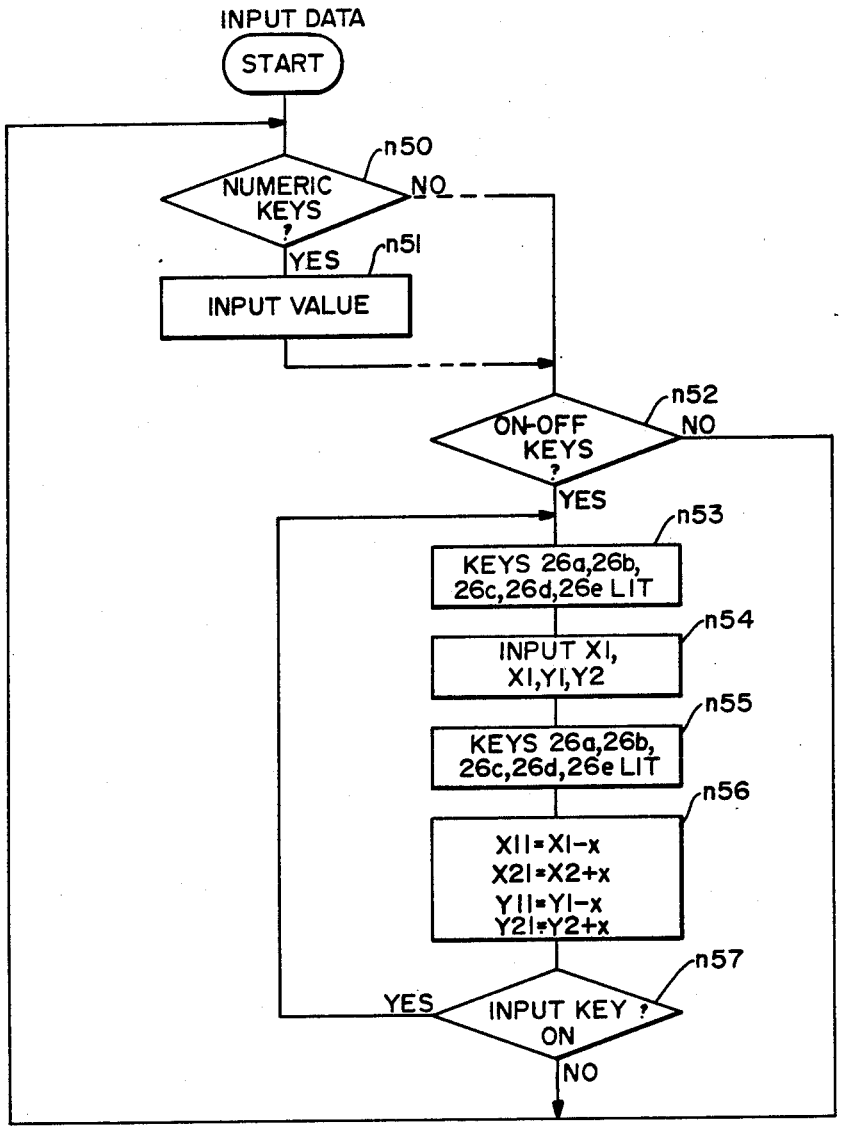
FIG. 2B is a flow chart for the input operation of a copier.

As explained above, each of the light emitting diodes 41 of the image erasing lamp 4 is adapted to expose a certain well-defined region of the photosensitive drum 1. Thus, if a region to be exposed on the photosensitive drum is determined, so are the light emitting diodes 41 to be switched on. For the convenience of explanation and description, the light emitting diodes 41 of the image erasing lamp 4 are divided into groups A, B, C and D as shown in FIG. 1B, Group A corresponding to the width of the frame-shaped region z, Group B corresponding to the inner rectangle of the region z, Group C corresponding to the region outside the outer rectangle of the region z on the document P and Group D corresponding to regions not covered by the document P. The light emitting diodes being thus grouped, are switched on and off according to the timing chart of FIG. 1C. FIG. 2C is a flow chart of a program for switching on and off the light emitting diodes 41 according to the timing chart of FIG. 1C. Data once inputted can be corrected, as explained above in connection with the frame defining input keys 26, until the print key 21 is switched on (n6) and a copying process is started (n7) according to a timing chart corresponding to the input frame data. In the case of the timing chart of FIG. 1C, all light emitting diodes 41 (of all groups) are initially switched off (n71) as a timer T (not shown) starts to measure the elapsed time (n72). This starting time is designated as START in FIG. 1C. The moment at which the timer shows T11 (n73) corresponds to the moment at which the photosensitive drum 1, rotating at a known speed, has come to such position that the image erasing lamp 4 is at X11. At this moment, the light emitting diodes 41 in Groups A and B are switched on (n74) to cancel charges in the range between Y11 and Y21. When the time T measures t1 (n75) corresponding to the arrival of the image erasing lamp 4 at X1, the light emitting diodes 41 in Group B are switched off (n76), those in Group A remaining lit. Thereafter, charges on the drum 1 are cancelled only along the two strips each of width x between Y11 and Y1 and between Y2 and Y21. Thereafter, when the time T measures t2 (n77), the image erasing lamp 4 is at X2 and the light emitting diodes 41 in Group B are switched on again (n78), and when the time T measures t21 (n79), the image erasing lamp 4 is at X21 and the light emitting diodes 41 in Groups A and B are switched off (n80). Still thereafter, when the timer T measures t3 (n81), all light emitting diodes 41 are switched on (n82).

By thus controlling the light emitting diodes 41 of the individual groups, a desired frame can be formed as shown in FIG. 1A. Thereafter, the number entered in the copy counter CC (also represented by CC) is reduced by 1 (n8) and if this number becomes zero (YES in Step 9), it means that the desired number of copies have been obtained and the copier is ready to accept new input data (n5).

The foregoing description of a preferred embodiment of the invention has been presented for purposes of illustration and description. It is not intended to be exhaustive or to limit the invention to the precise form disclosed and many modifications and variations are possible in light of the above teaching. For example, the width x of the frame-shaped region need not be prefixed but may be made variable such that a desired value of x can be inputted through any inputting means of a known type (not shown) from the control panel 2. With a copier having two or more developing devices, furthermore, the regions to be exposed may be reversed such that only the regions other than the region determined by calculations are exposed. Such modifications and variations that may be apparent to a person skilled in the art are intended to be included within the scope of this invention.

What is claimed is:

1. An image forming apparatus comprising an image erasing lamp secured between a charger for uniformly charging the surface of a photosensitive drum and a developing device and elongated in the direction of the axis of said drum, said image erasing lamp including a plurality of point light sources which can be individually switched on and off, rectangular region setting means for specifying two X coordinates and two Y coordinates and thereby setting on an original document sheet a rectangular region with sides lying along X and Y directions, frame-shaped region determining means for adding and subtracting a value representing a specified width to or from said X and Y coordinates to thereby determine a frame-shaped region having said specified width and positioned around a region set by said rectangular region setting means, and lamp control means for controlling the timing of switching said point light sources on and off during an image forming process such that only the region on said photosensitive drum corresponding to said frame-shaped region is exposed by said light sources and that electrostatic charges are thereby cancelled in said corresponding region on said photosensitive drum.

2. The image forming apparatus of claim 1 further comprising width selecting means for selectively varying said specified width of said frame-shaped region.

* * * * *